US005800147A

United States Patent [19]

Arai et al.

[11] Patent Number: 5,800,147

[45] Date of Patent: Sep. 1, 1998

[54] SWASH PLATE COMPRESSOR

[75] Inventors: Katsuhiko Arai; Katsutoshi Enomoto; Kiyoshi Yoshii; Hisao Ichikawa, all of Saitama-ken, Japan

[73] Assignee: Zexel Corporation, Tokyo, Japan

[21] Appl. No.: 834,719

[22] Filed: Apr. 1, 1997

[30] Foreign Application Priority Data

Apr. 19, 1996 [JP] Japan ..... 8-122661

[51] Int. Cl.[6] ..... F04B 1/12

[52] U.S. Cl. ..... 417/269; 92/71

[58] Field of Search ..... 417/312, 313, 417/269; 92/71, 12.2

[56] References Cited

U.S. PATENT DOCUMENTS

| | | | |
|---|---|---|---|
| 3,785,751 | 1/1974 | Nemoto et al. | 92/71 |
| 4,544,332 | 10/1985 | Shibuya | 417/269 |
| 4,583,922 | 4/1986 | Iijima et al. | 417/313 |
| 4,813,852 | 3/1989 | Ikeda et al. | 417/269 |
| 5,139,392 | 8/1992 | Pettitt et al. | 417/312 |

*Primary Examiner*—Thomas E. Denion

*Attorney, Agent, or Firm*—Frishauf, Holtz, Goodman, Langer & Chick

[57] ABSTRACT

There is provided a swash plate compressor which ensures reduction of pulsation of refrigerant gas during operation thereof and at the same time enhances mechanical efficiency of the compressor. Refrigerant gas delivered from front-side compression chambers is introduced into a front-side discharge chamber, and refrigerant gas delivered from rear-side compression chambers is introduced into a rear-side discharge chamber. At least two refrigerant outlet passages each arranged in a fashion parallel with a plurality of cylinder bores which extend longitudinally through a cylinder block communicate the front-side discharge chamber with the rear-side discharge chamber. A discharge port which is formed in a head secured to a front-side end or rear-side end of the cylinder block permits the refrigerant gas within the front-side and rear-side discharge chambers to be discharged out of the head. One of the at least two refrigerant outlet passages is communicated with the discharge port. The cylinder block is formed therein with a guide passage for communicating an intermediate portion of any of the at least two refrigerant outlet passages other than the one of the at least two refrigerant outlet passages being communicated with the discharge port, with the one of the at least two refrigerant outlet passages being communicated with the discharge port.

4 Claims, 12 Drawing Sheets

SWASH PLATE COMPRESSOR

BACKGROUND OF THE INVENTION

1. Field of the Invention

This invention relates to a swash plate compressor, and more particularly to a swash plate compressor having a construction which is capable of reducing pulsation of flow of refrigerant gas under discharge pressure.

2. Description of the Prior Art

FIG. 1 shows the whole arrangement of a conventional swash plate compressor. FIG. 2 is a view taken on line G—G of FIG. 1.

The conventional swash plate compressor 100 includes a front-side discharge chamber 124*a* into which is introduced refrigerant gas delivered from front-side compression chambers, not shown, a rear-side discharge chamber 124*b* into which is introduced refrigerant gas delivered from rear-side compression chambers, not shown, three refrigerant outlet passages 131 to 133 which communicate the front-side discharge chamber 124*a* with the rear-side discharge chamber 124*b*, and a discharge port 140 through which the refrigerant gas within the front-side discharge chamber 124*a* and the rear-side discharge chamber 124*b* is discharged out of a rear head 106. The discharge port 140 opens in the rear head 106 secured to a rear-side end of a cylinder block 101 via a valve plate 105. Open arrows shown in FIG. 1 indicate flows of refrigerant gas, respectively.

The cylinder block 101 is formed with a through hole 150 through which a drive shaft 180 extends, five cylinder bores 111 which are arranged at predetermined circumferentially-spaced intervals around the through hole 150 and extend longitudinally in a fashion parallel with the through hole 150, the three refrigerant outlet passages 131 to 133 which extend in a fashion parallel with the cylinder bores 111, and a refrigerant inlet passage 134 through which flows low-pressure refrigerant.

The refrigerant outlet passages 131 to 133 are communication passages for communicating the front-side discharge chamber 124*a* with the rear-side discharge chamber 124*b*.

FIG. 3 is a view taken on line H—H of FIG. 2.

Out of the refrigerant outlet passages 131 to 133, only the outlet passage 132 is communicated with the discharge port 140 via a port 105*a* formed through the valve plate 105. Open arrows shown in FIG. 3 indicate flows of refrigerant, respectively.

Low-pressure refrigerant drawn into the compressor via a suction port 160 opening in the rear head 106 (see FIG. 1) is introduced through the refrigerant inlet passage 134 to each of the compression chambers within the cylinder bores 111, where the low-pressure refrigerant is compressed by a piston, not shown, and delivered to the front-side and rear-side discharge chambers 124*a*, 124*b*, respectively. Thereafter, the compressed refrigerant (high-pressure gas to be discharged) flows from the discharge chambers 124*a*, 124*b* via ports 103*b* and 105*b* formed through a valve plate 103 and the valve plate 105, respectively, into the refrigerant outlet passage 132. The refrigerant from the port 105*b* joins the refrigerant from the port 103*b* within the refrigerant outlet passage 132, and the confluent refrigerant flows into the discharge port 140, followed by being discharged to an external circuit.

In the swash plate compressor constructed as above, pulsation of flow of refrigerant gas dependent on the number of cylinders can occur, causing vibrations and noises.

To overcome this problem, the conventional swash plate compressor utilizes the valve plates 103, 105 to provide restrictions (such as the ports 103*a*, 103*b*, 105*a*, 105*b*, and a port 105*c*) in the outlet passages 131–133 as described above. Further, the refrigerant outlet passages 131 to 133 are each formed such that its intermediate portion has a small cross-sectional dimension, and a muffler, not shown, is provided in a piping system for communicating the compressor with the external circuit.

However, since the pressure within the front-side discharge chamber 124*a* and that within the rear-side discharge chamber 124*b* are substantially equal in level, refrigerant gas tends to be standing within the refrigerant outlet passages 131 and 133 other than the passage 132 which communicates with the discharge port 140 via the port 105*a*. As a result, the refrigerant outlet passages 131 and 133 are not capable of serving as mufflers, so that the pulsation cannot be fully reduced as a whole.

Further, a path of flow of refrigerant gas from the discharge chambers 124*a* to the discharge port 140 and a path of flow of the same from the discharge chamber 124*b* to the discharge port 140 are different in length. This difference in the paths of flow results in a difference in passage resistance (resistance to a flow of refrigerant within the passage) between the flow from the front side and that from the rear side, which decreases mechanical efficiency of the compressor.

SUMMARY OF THE INVENTION

It is an object of the invention to provide a swash plate compressor which is capable of reducing pulsation of flow of refrigerant and at the same time enhancing mechanical efficiency thereof.

To attain the above object, the present invention provides a swash plate compressor including a cylinder block, a plurality of cylinder bores extending through the cylinder block, a plurality of pistons received within the plurality of cylinders, respectively, front-side compression chambers formed within the cylinder bores on front sides of the pistons, respectively, a front-side discharge chamber to which refrigerant gas is delivered from the plurality of front-side compression chambers, rear-side compression chambers formed within the cylinder bores on rear sides of the pistons, respectively, a rear-side discharge chamber to which the refrigerant gas is delivered from the plurality of rear-side compression chambers, at least two refrigerant outlet passages extending through the cylinder block in a fashion parallel with the plurality of cylinder bores, for communicating the front-side discharge chamber with the rear-side discharge chamber, a head secured to a front-side end of the cylinder block or a rear-side end of the cylinder block, and a discharge port formed through the head to permit the refrigerant gas within the front-side discharge chamber and the refrigerant gas within the rear-side discharge chamber to be discharged out of the head, one of the at least two refrigerant outlet passages being communicated with the discharge port.

The swash plate compressor according to the invention is characterized in that the cylinder block is formed with a guide passage therein for communicating an intermediate portion of any of the at least two refrigerant outlet passages other than the one of the at least two refrigerant outlet passages being communicated with the discharge port, with the one of the at least two refrigerant outlet passages being communicated with the discharge port.

According to the invention, since the cylinder block has the guide passage therein for communicating the intermediate portion of any of the at least two refrigerant outlet passages other than the one of the at least two refrigerant outlet passages being communicated with the discharge port, with the one of the at least two refrigerant outlet passages being communicated with the discharge port, refrigerant is permitted to flow from the former, which is not communicated with the discharge port, to the latter, which is communicated with the discharge port, whereby refrigerant is prevented from becoming standing within the any of the refrigerant outlet passages other than the refrigerant outlet passage communicated with the discharge port. As a result, the any of the passages other than the refrigerant outlet passage communicated with the discharge port can serve effectively as a muffler space. Therefore, pulsation of flow of refrigerant can be fully reduced, so that vibration and noises due to the pulsation can be positively prevented. Further, there is no need to provide a muffler in a piping system for communicating the compressor with an external circuit, which makes it possible to reduce manufacturing costs of a whole air-conditioning system including the compressor.

Preferably, the intermediate portion of any of the at least two refrigerant outlet passages other than the one of the at least two refrigerant outlet passages being communicated with the discharge port is a substantially midway portion of the any of the at least two refrigerant outlet passages other than the one of the at least two refrigerant outlet passages being communicated with the discharge port.

According to the preferred embodiment, since the any of the refrigerant outlet passages other than the refrigerant outlet passage communicated with the discharge port has its intermediate portion communicated with the one of the at least two refrigerant outlet passages being communicated with the discharge port via the guide passage, the pressure loss of refrigerant flowing from the front side and that of refrigerant flowing from the rear side are substantially equal to each other, whereby mechanical efficiency can be enhanced.

More preferably, the cylinder block comprises two blocks joined to each other, and the guide passage is formed in a junction of the two cylinder blocks.

According to this preferred embodiment, it is easy to form the guide passage.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
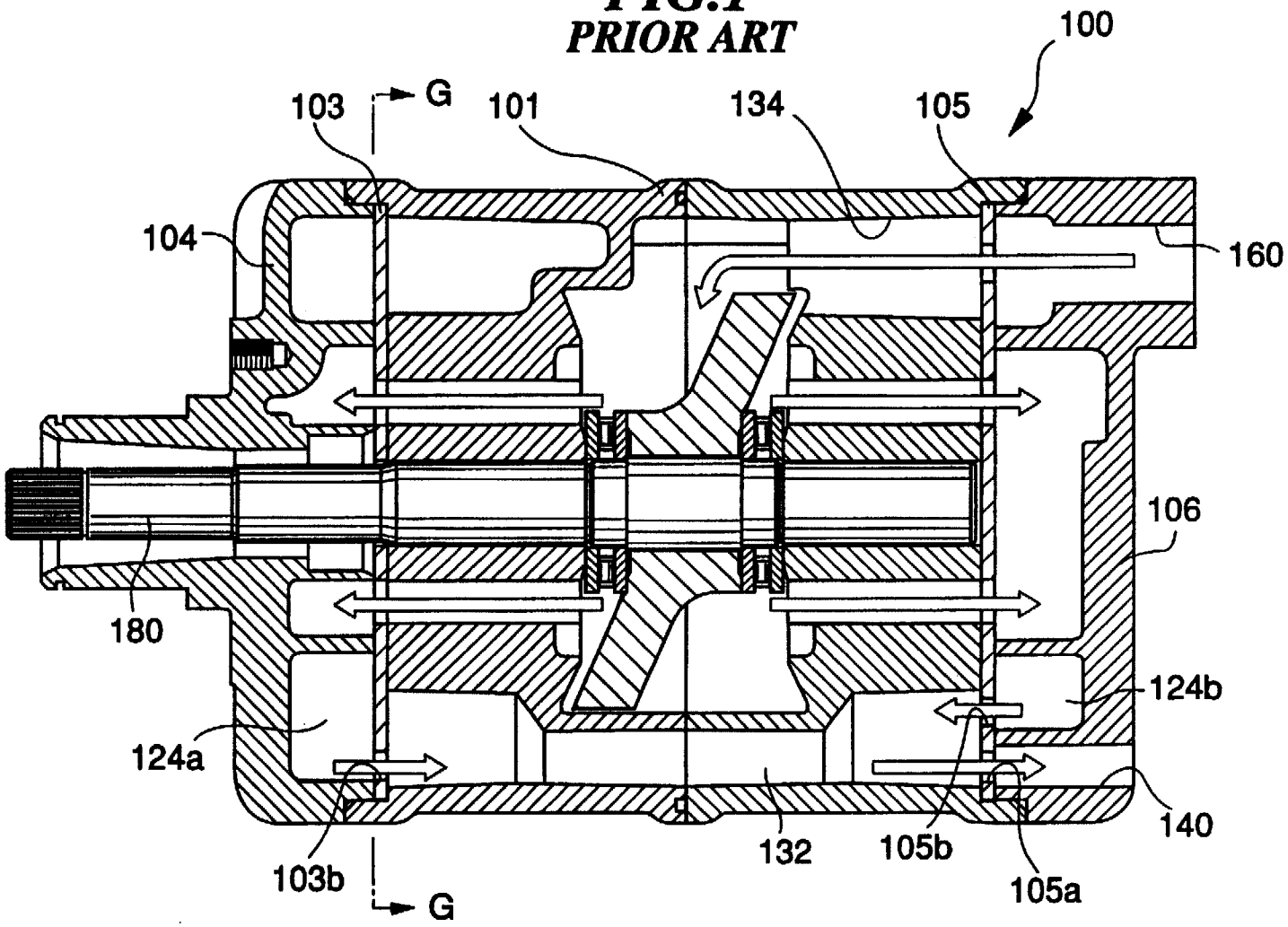
FIG.1 PRIOR ART
FIG. 1 is a longitudinal cross-sectional view showing the whole arrangement of a conventional swash plate compressor.
Figure 2:
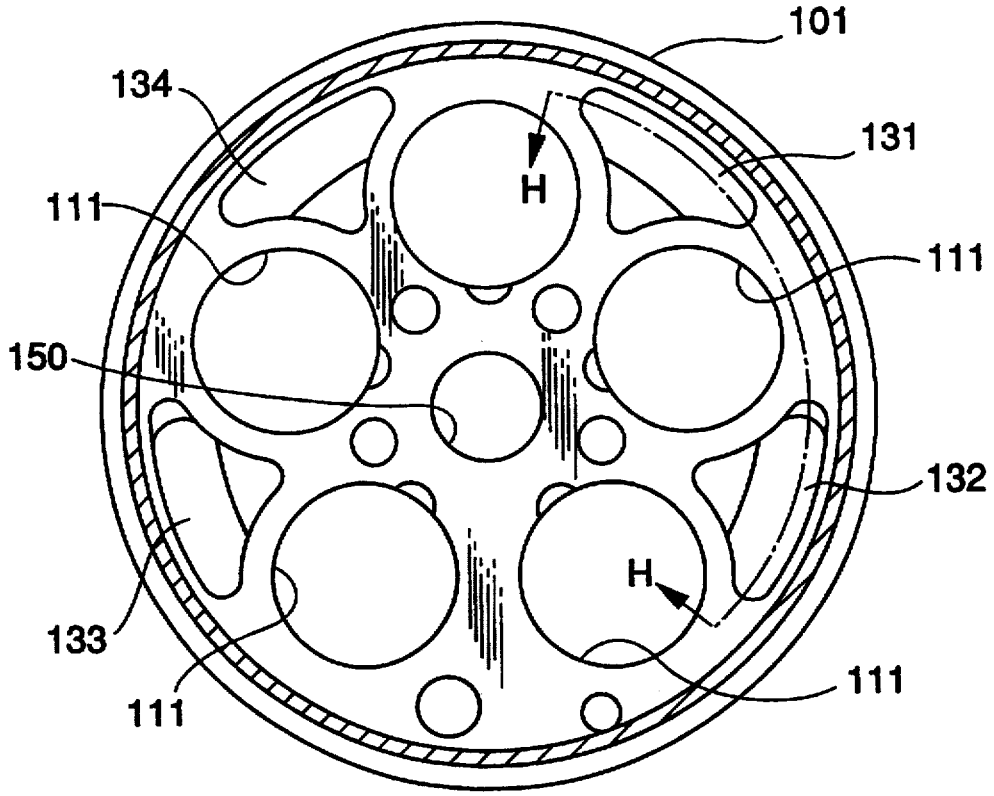
FIG.2 PRIOR ART
FIG. 2 is a view taken on line G—G of FIG. 1.
Figure 3:
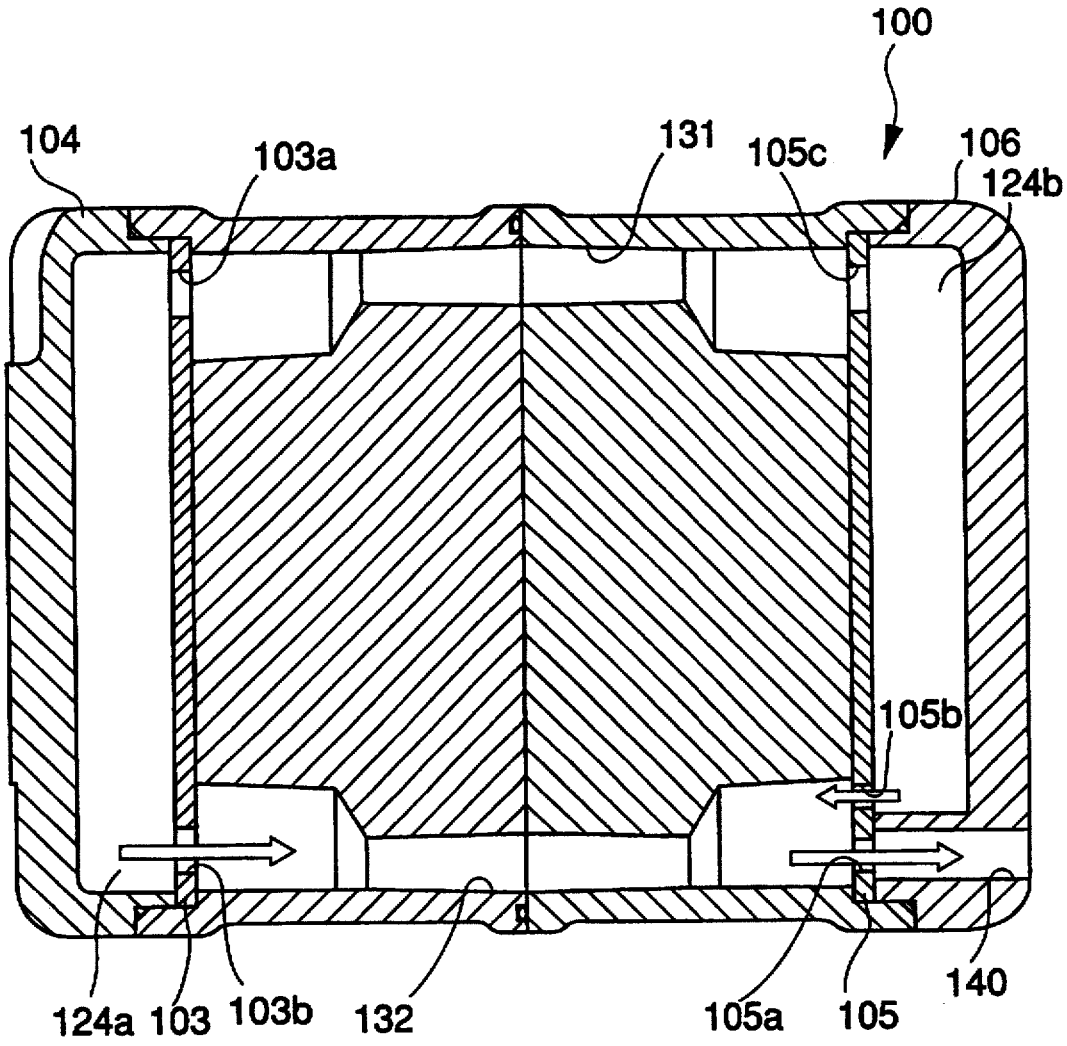
FIG.3 PRIOR ART
FIG. 3 is a cross-sectional view taken on line H—H of FIG. 2.
Figure 4:
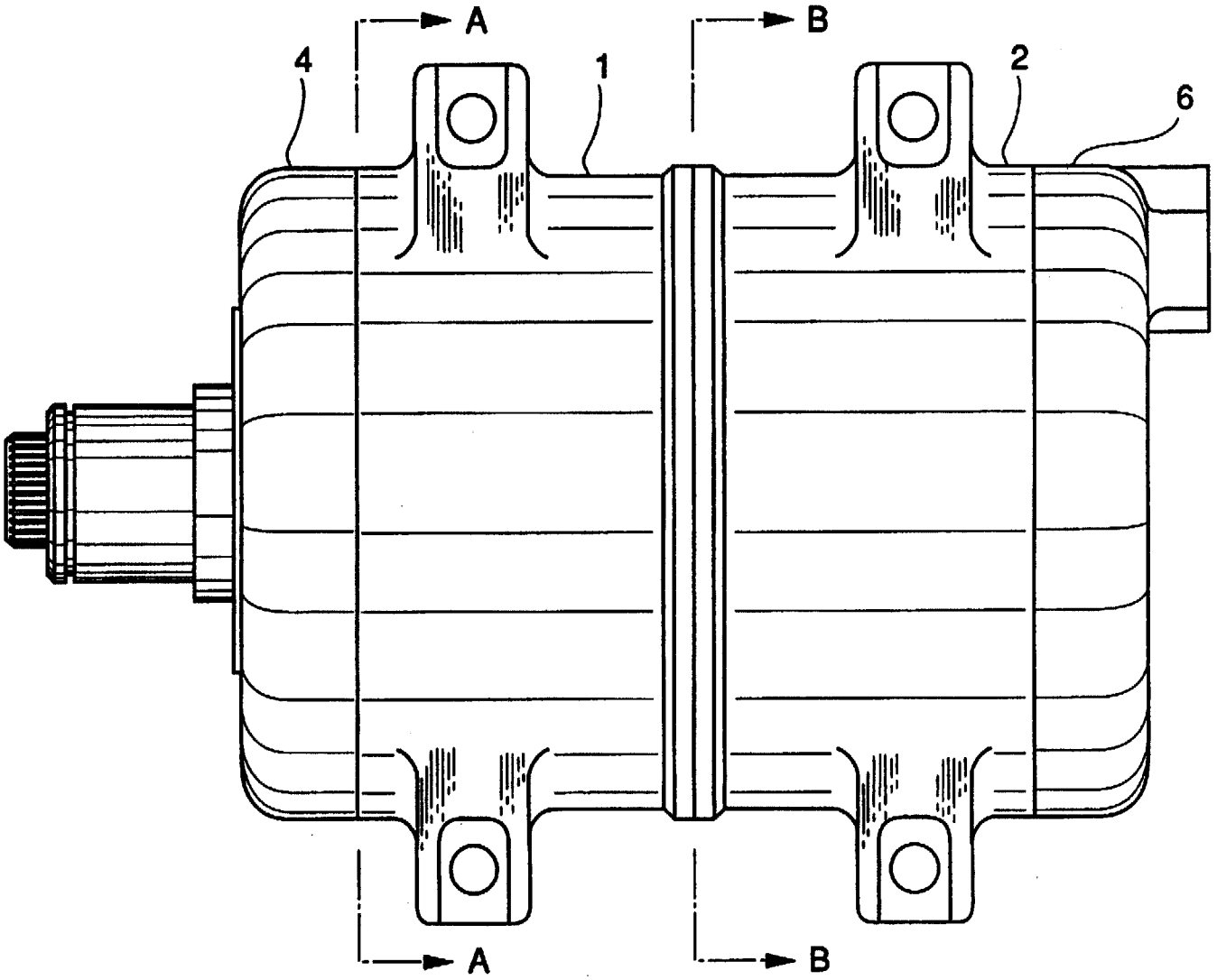
FIG. 4 is a side elevational view of a swash plate compressor according to an embodiment of the invention.

FIG. 4 is a side elevational view of a swash plate compressor according to an embodiment of the invention.

The swash plate compressor includes cylinder blocks 1 and 2 arranged on a front side and a rear side, respectively, and front and rear heads 4 and 6 secured to a front-side end of the front-side cylinder block and a rear-side end of the rear-side cylinder block, respectively.

Figure 5:
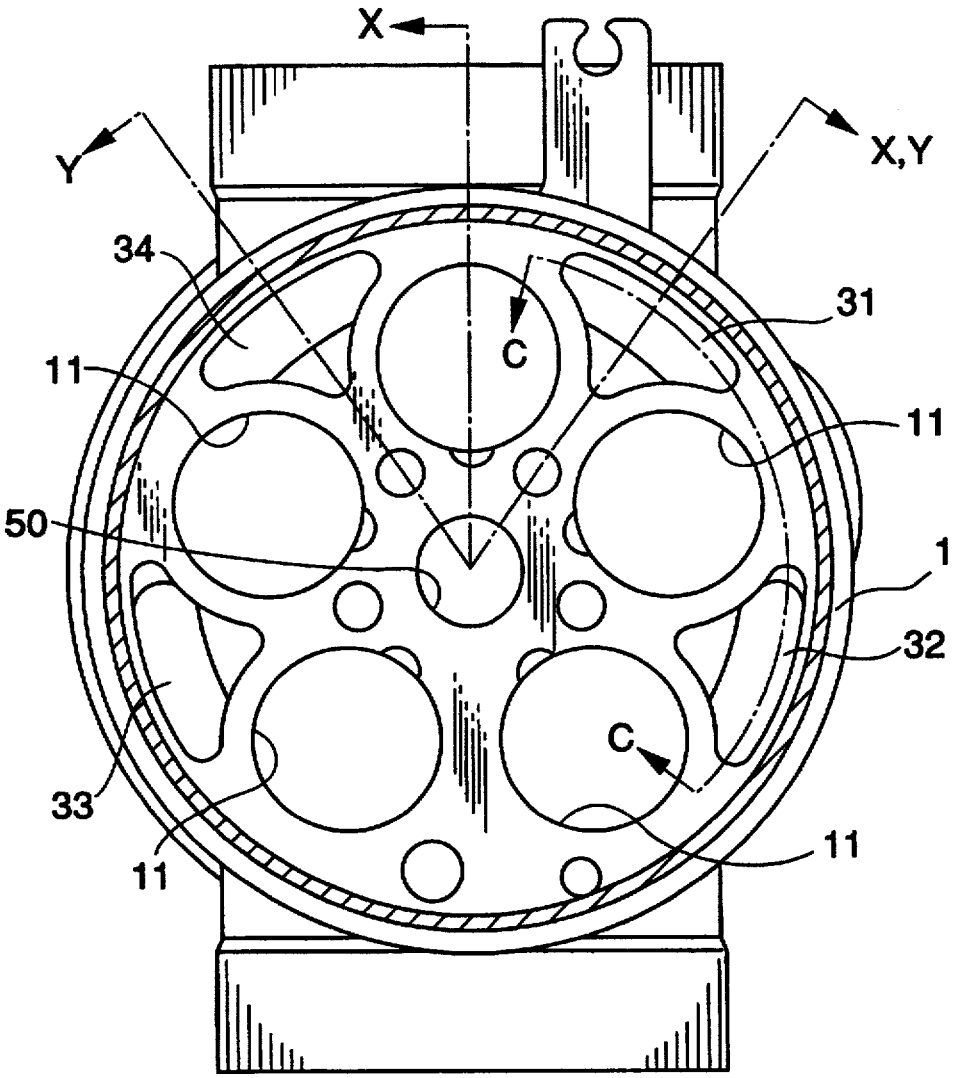
FIG. 5 is a view taken on line A—A of FIG. 4.
Figure 6:
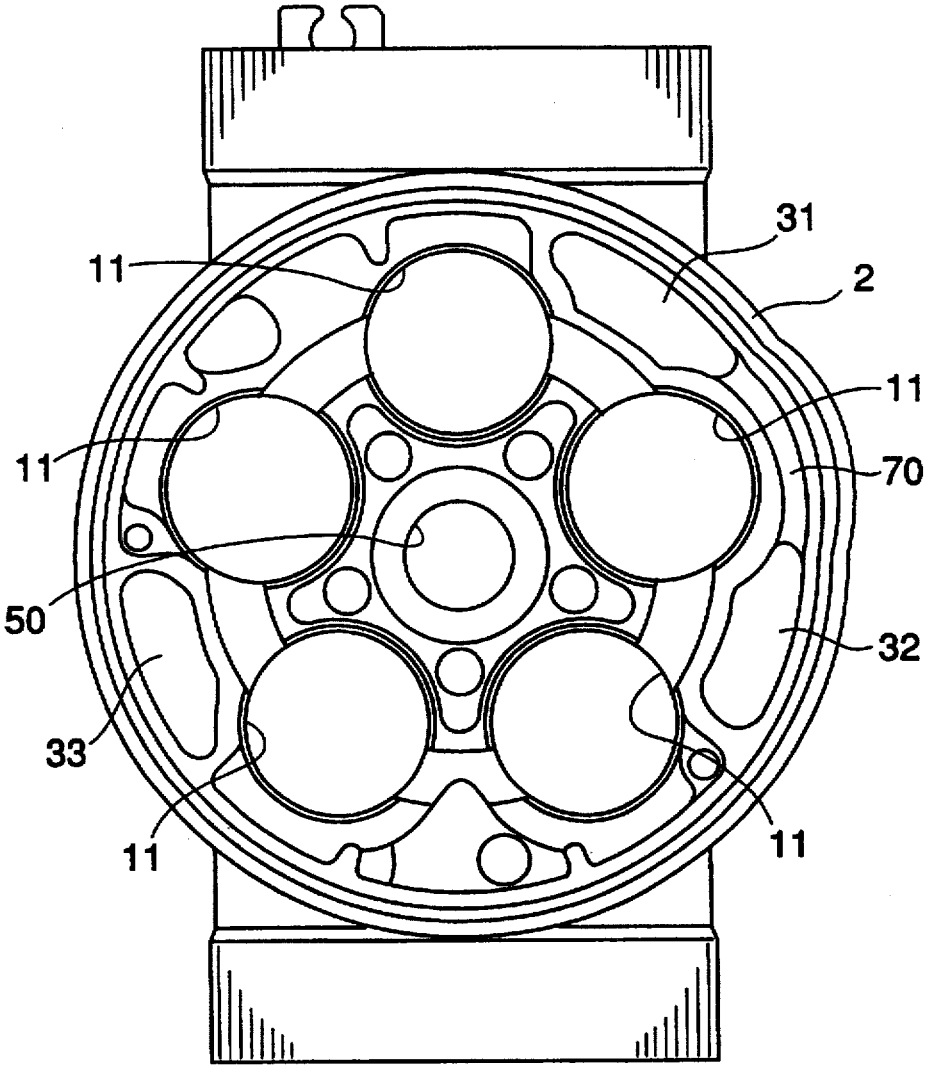
FIG. 6 is a view taken on line B—B of FIG. 4.

FIG. 5 is a view of the swash plate compressor taken on line A—A of FIG. 4, and FIG. 6 a view taken on line B—B of the same. Pistons and a drive shaft are not shown in the figures.

The cylinder block 1 is formed with a through hole 50 through which a drive shaft 7 extends, five cylinder bores 11 which are arranged at predetermined circumferentially-spaced intervals around the through hole 50 and extend longitudinally in a fashion parallel with the through hole 50, three refrigerant outlet passages 31 to 33 which extend in a fashion parallel with the cylinder bores 11, and a refrigerant inlet passage 34 through which low-pressure refrigerant flows.

Figure 7:
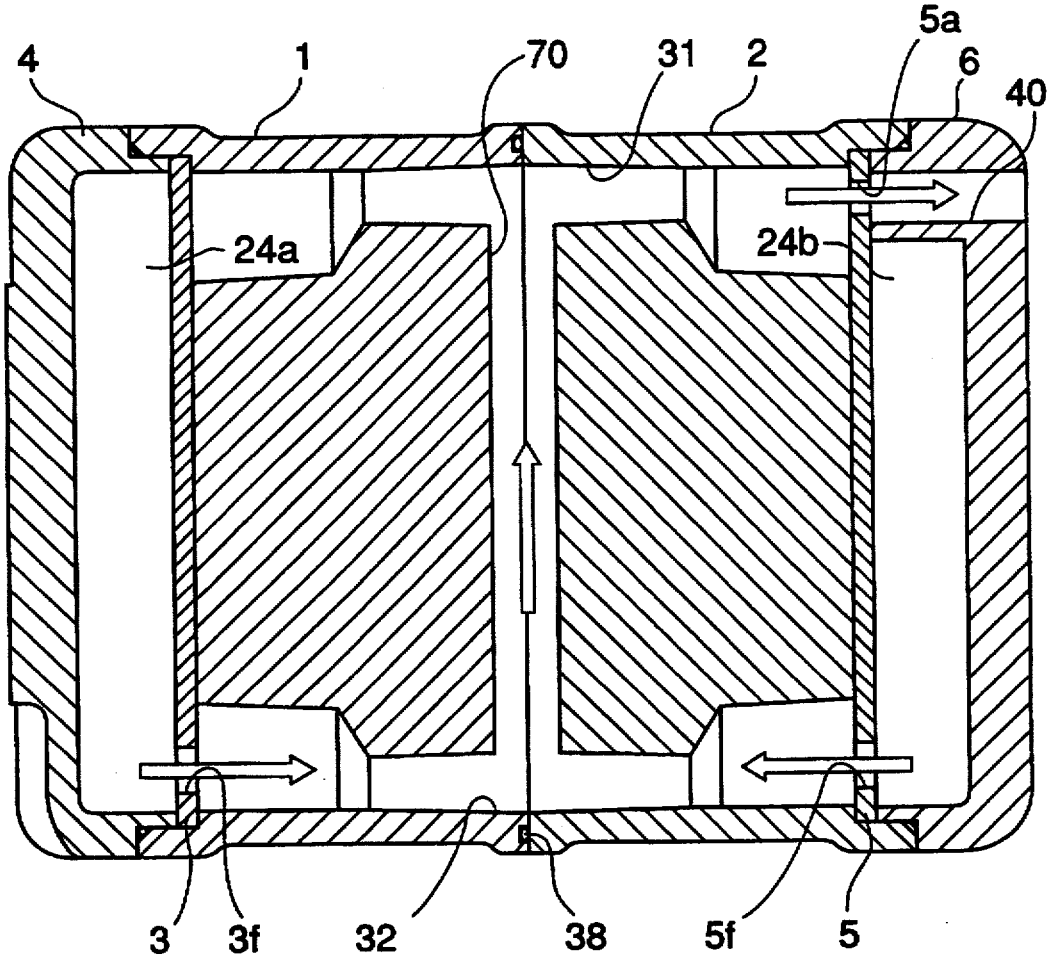
FIG. 7 is a cross-sectional view taken on line C—C of FIG. 5, which shows essential parts of the swash plate compressor according to the embodiment of the invention.

FIG. 7 is a view taken on line C—C of FIG. 5.

The refrigerant outlet passages 32, 33, communicate with discharge chambers **24*a* and 24*b* via ports 3*f* and 5*f* formed through a valve plate 3 and a valve plate 5, respectively, and the other refrigerant outlet passage 31 communicates with a discharge port 40 via a port 5*a*. Further, a guide passage 70 which communicates an intermediate portion of the refrigerant outlet passage 31 with an intermediate portion of the refrigerant outlet passage 32 extends in a junction of the cylinder blocks 1 and 2**. Open arrows shown in FIG. 7 indicate flows of refrigerant.

Figure 8:
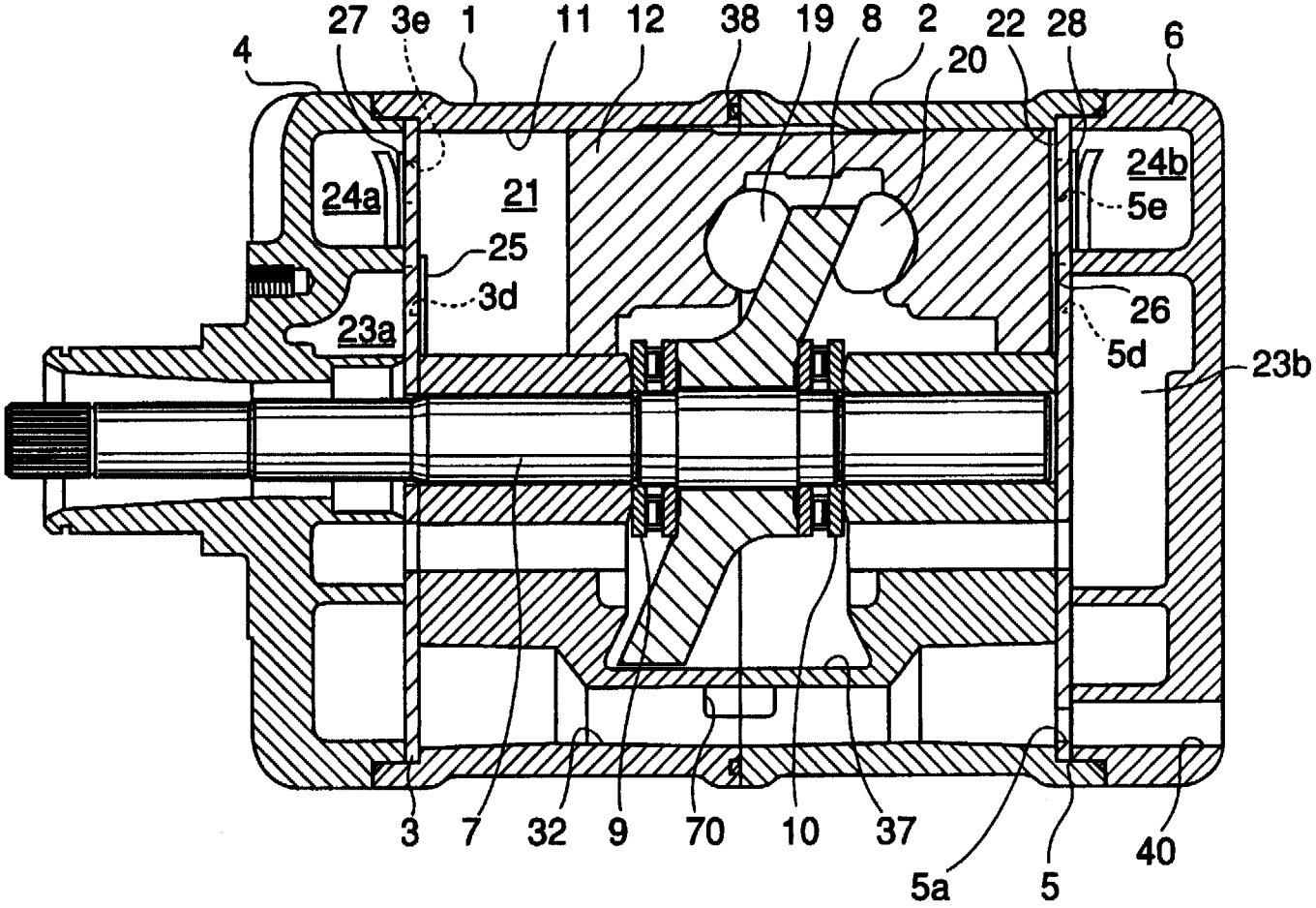
FIG. 8 is a cross-sectional view taken on line X—X of FIG. 5.
Figure 9:
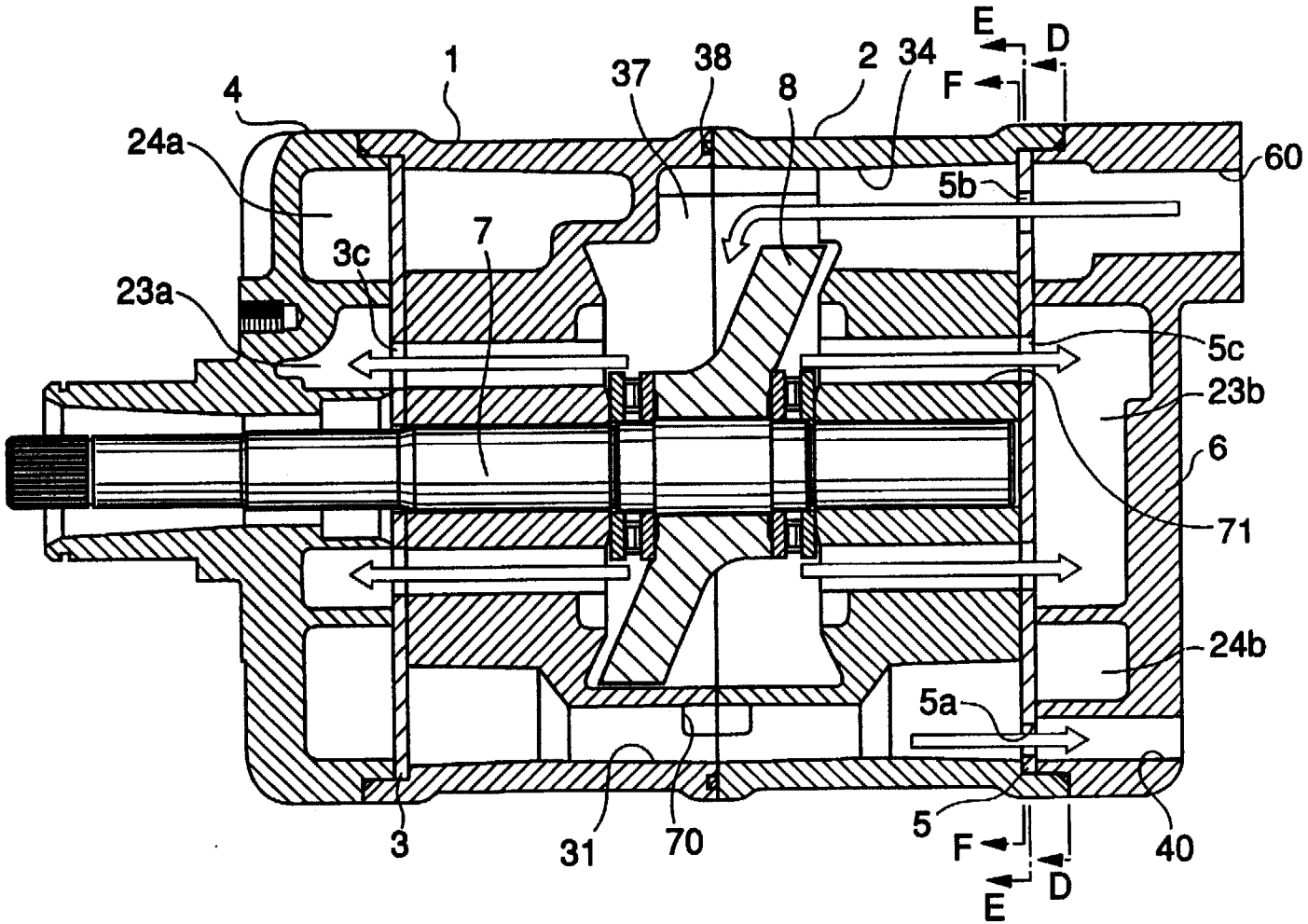
FIG. 9 is a cross-sectional view taken on line Y—Y of FIG. 5.

FIG. 8 is a view taken on line X—X of FIG. 5, and FIG. 9 a view taken on line Y—Y of FIG. 5.

The front-side cylinder block 1 and the rear-side cylinder block 2 are assembled such that opposed ends thereof are joined to each other via an O ring 38, to form an assembly of the cylinder block 1, 2. The assembly of the cylinder blocks 1, 2 has one end thereof secured to the front head 4 via the valve plate 3, and the other end thereof secured to the rear head 6 via the valve plate 5.

The drive shaft 7 longitudinally extends through the center of the assembly of the cylinder blocks 1,2, and a swash plate 8 is rigidly fitted on the drive shaft 7. The drive shaft 7 and the swash plate 8 are rotatably supported in the cylinder block via thrust bearings 9, 10. The swash plate 8 is received within a swash plate chamber 37 defined between end faces of the opposed ends of the cylinder blocks 1, 2 at the junction thereof.

Within each cylinder bore 11, compression chambers 21, 22 are formed on opposite sides of a piston 12, respectively. The piston 12 is connected to the swash plate 8 via shoes 19, 20, each of which is substantially in the form of a hemisphere, whereby the piston 12 reciprocates within the cylinder bore 11 according to rotation of the swash plate 8.

Figure 10:
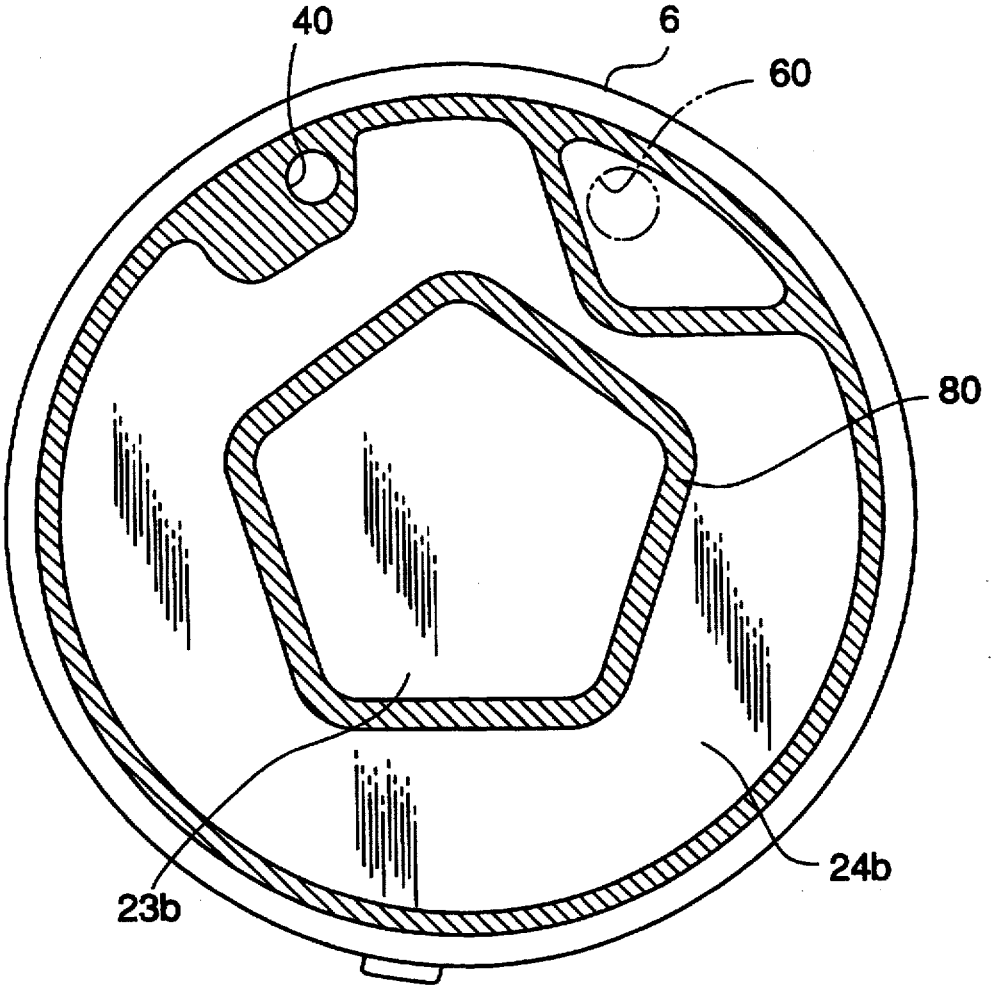
FIG. 10 is a cross-sectional view taken on line D—D of FIG. 9.

FIG. 10 is a view taken on line D—D of FIG. 9.

The rear head 6 is circular in cross section. A suction port 60 and the discharge port 40 are formed through the rear head 6. Further, the rear head 6 is formed therein with a suction chamber 23*b* and the discharge chamber 24*b*, which are separated from each other by a partition wall 80.

Figure 11:
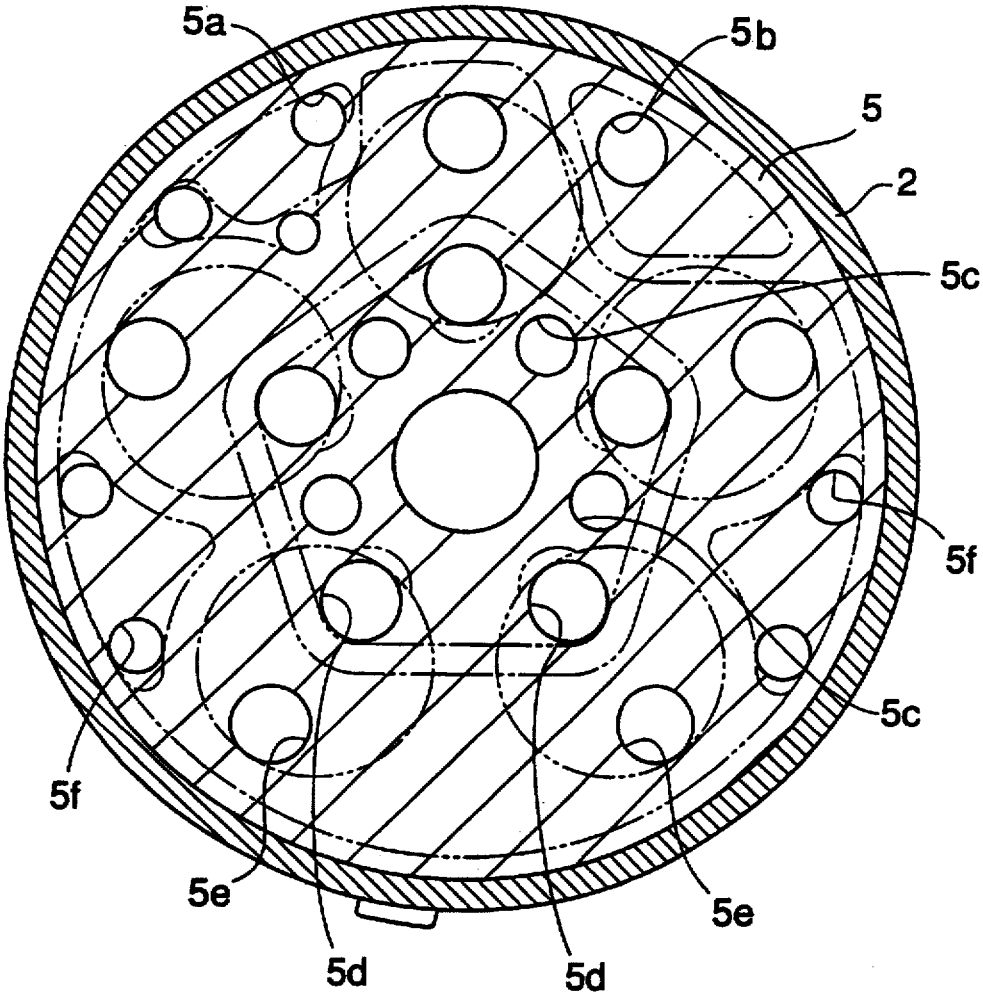
FIG. 11 is a cross-sectional view taken on line E—E of FIG. 9.

FIG. 11 is a view taken on line E—E of FIG. 9.

The valve plate 5 is formed therethrough with the port 5*a* and a port 5*b* which communicate the refrigerant inlet passage 34 and the refrigerant outlet passage 31 in the cylinder block 2 with the suction port 60 and the discharge port 40 in the rear head 6, respectively, and ports 5*c* which communicate passages 71 in the cylinder block 2, which communicate with the swash plate chamber 37, with the suction chamber 23*b*.

Figure 12:
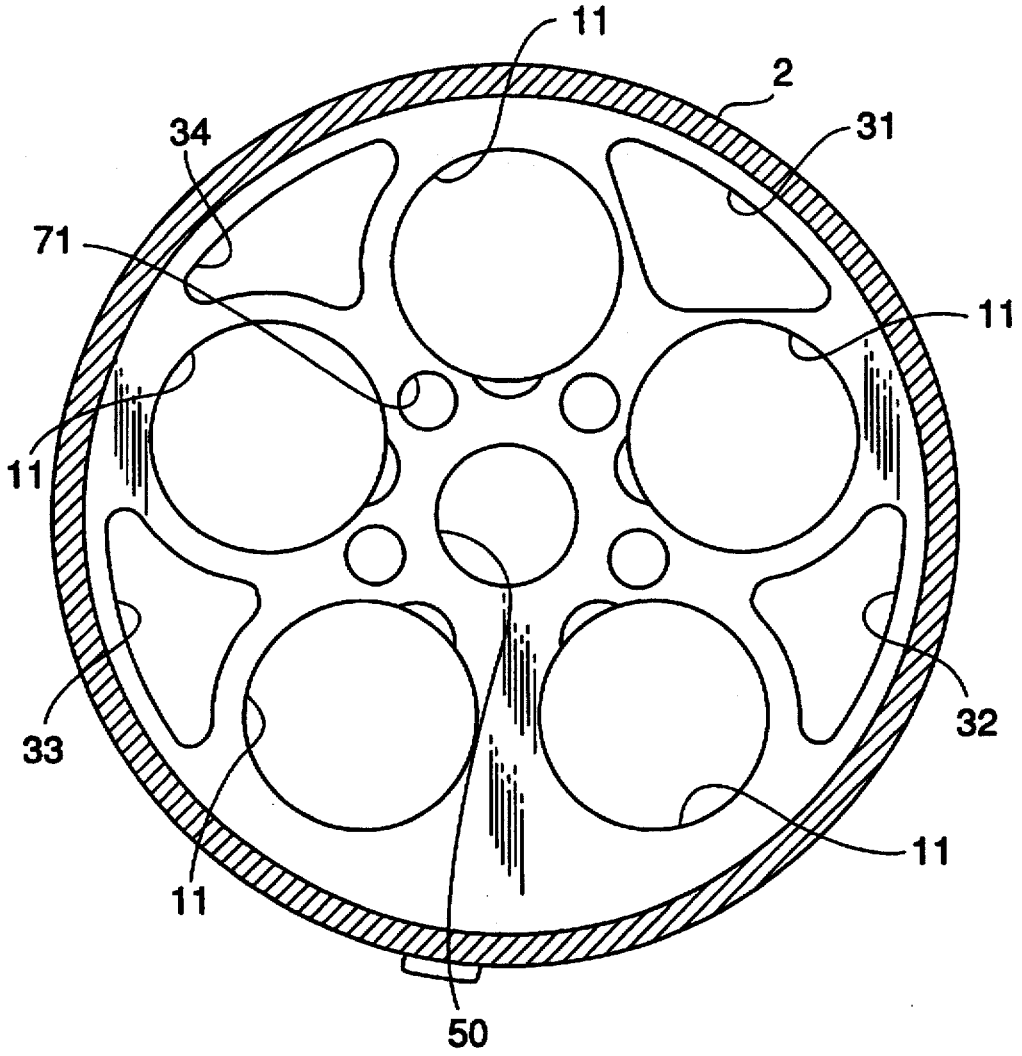
FIG. 12 is a cross-sectional view taken on line F—F of FIG. 9.

FIG. 12 is a view taken on line F—F of FIG. 9.

The cylinder block 2 is formed therein with the cylinder bores 11, the refrigerant outlet passages 31 to 33, and the refrigerant inlet passage 34 communicated with the port 5*b*.

Next, the operation of the swash plate compressor according to the present embodiment will be described with reference to FIGS. 7 to 9.

When the compressor is driven to rotate the drive shaft 7, the swash plate 8 rotates in unison with the drive shaft 7, and the torque transmitted from the swash plate 8 is converted into reciprocation of the piston 12 within the cylinder bore 11.

As the piston 12 reciprocates, refrigerant is drawn from an external circuit (i.e. an evaporator, not shown) into the suction chambers 23*a*, 23*b* via the suction port 60, the port 5*b*, the swash plate chamber 37, and the respective ports 3*c* and 5*c*.

As the swash plate 8 rotates through 180 degrees after the piston 12 is at a position closest to the valve plate 3 (left-side extremity position in FIG. 8) (i.e. after the piston 12 is at its top dead center position within the compression chamber 21), the piston 12 slides to a position shown in FIG. 8 (right-side extremity position in FIG. 8), whereby the suction stroke is completed in the compression chamber 21, while the compression stroke is completed in the compression chamber 22.

Thereafter, when the swash plate 8 further rotates through 180 degrees, the suction stroke is completed in the compression chamber 22, while the compression stroke is completed in the compression chamber 21.

During the suction stroke, suction valves 25, 26 open to permit refrigerant to flow from the suction chambers 23*a*, 23*b* into the compression chambers 21, 22 via ports 3*d*, 5*d*, respectively.

During the compression stroke, the refrigerant compressed by the piston 12 within the respective compression chambers 21, 22 opens discharge valves 27, 28 to flow into the discharge chambers 24*a*, 24*b* via ports 3*e*, 5*e* as a high-pressure refrigerant, respectively.

Part of the high-pressure refrigerant delivered to the discharge chambers 24*a*, 24*b* flows into the refrigerant outlet passage 32 via the ports 3*f*, 5*f*.

The refrigerant flowing into the refrigerant outlet passage 32 via the port 3*f* and the refrigerant flowing into the same via the port 5*f* meet at the middle of the refrigerant outlet passage 32 to form a confluent flow and then pass through the guide passage 70, the refrigerant outlet passage 31 and the port 5*a*, sequentially, followed by being delivered to an external circuit (condenser) via the discharge port 40.

The flows of refrigerant from the discharge chambers 24*a*, 24*b* are restricted when they pass through the ports 3*f*, 5*f*, and expand after entering the refrigerant outlet passage 32. Then, they are restricted again at the intermediate portion of the refrigerant outlet passage 32 where they meet, and the confluent refrigerant flows through the guide passage 70 into the refrigerant outlet passage 31, where it expands again. The expanded refrigerant is restricted again when passing through the port 5a into the discharge port 40.

According to the present embodiment of the invention, refrigerant is not standing within the refrigerant outlet passage 32. Therefore, the refrigerant outlet passage 32 is capable of serving effectively as a muffler space, which makes it possible to fully reduce pulsation of the refrigerant flow.

Further, since the refrigerant outlet passages 31 and 32 have the intermediate portions thereof communicated with each other via the guide passage 70, pressure losses produced on the front side and the rear side when refrigerant flows through the passages are equal to each other. That is, the flow of refrigerant from the front side and that from the rear side are balanced, whereby the amount of work done (mechanical efficiency) is made equal between the front side and the rear side.

What is claimed is:

1. In a swash plate compressor including a cylinder block, a plurality of cylinder bores extending through said cylinder block, a plurality of pistons received within said plurality of cylinders, respectively, front-side compression chambers formed within said cylinder bores on front sides of said pistons, respectively, a front-side discharge chamber to which refrigerant gas is delivered from said plurality of front-side compression chambers, rear-side compression chambers formed within said cylinder bores on rear sides of said pistons, respectively, a rear-side discharge chamber to which said refrigerant gas is delivered from said plurality of rear-side compression chambers, at least two refrigerant outlet passages extending through said cylinder block in a fashion parallel with said plurality of cylinder bores, for communicating said front-side discharge chamber with said rear-side discharge chamber, a head secured to a front-side end of said cylinder block or a rear-side end of said cylinder block, and a discharge port formed through said head to permit said refrigerant gas within said front-side discharge chamber and said refrigerant gas within said rear-side discharge chamber to be discharged out of said head, one of said at least two refrigerant outlet passages being communicated with said discharge port, the improvement wherein said cylinder block has a guide passage formed therein for communicating an intermediate portion of any of said at least two refrigerant outlet passages other than said one of said at least two refrigerant outlet passages being communicated with said discharge port, with said one of said at least two refrigerant outlet passages being communicated with said discharge port.

2. A swash plate compressor according to claim 1, wherein said intermediate portion of any of said at least two refrigerant outlet passages, other than said one of said at least two refrigerant outlet passages being communicated with said discharge port, is a substantially midway portion of said any of said at least two refrigerant outlet passages other than said one of said at least two refrigerant outlet passages being communicated with said discharge port.

3. A swash plate compressor according to claim 1, wherein said cylinder block comprises two blocks joined to each other, and wherein said guide passage is formed in a junction of said two cylinder blocks.

4. A swash plate compressor according to claim 2, wherein said cylinder block comprises two blocks joined to each other, and wherein said guide passage is formed in a junction of said two cylinder blocks.

* * * * *